United States Patent [19]

Davies et al.

[11] 4,380,899

[45] Apr. 26, 1983

[54] REHEAT SYSTEMS FOR GAS TURBINE ENGINES

[75] Inventors: David O. Davies, Duffield; Michael Sherwood, Kegworth, both of England

[73] Assignee: Rolls-Royce Limited, London, England

[21] Appl. No.: 874,123

[22] Filed: Jan. 19, 1978

[30] Foreign Application Priority Data

Jan. 21, 1977 [GB] United Kingdom ..... 2479/77

[51] Int. Cl.[3] ..... F02K 3/10

[52] U.S. Cl. ..... 60/261; 60/749

[58] Field of Search ..... 60/39.72 R, 261, 749

[56] References Cited

U.S. PATENT DOCUMENTS 3,908,363 9/1975 Bauerfeind ..... 60/261

FOREIGN PATENT DOCUMENTS 768058 6/1955 Fed. Rep. of Germany ..... 60/39.72 R

*Primary Examiner*—Stephen C. Bentley

*Attorney, Agent, or Firm*—Cushman, Darby & Cushman

[57] ABSTRACT

The outermost gutter of a reheat system has an extended outer wall to two or three times the length of the inner wall of the outermost gutter. This causes a single vortex to develop instead of the usual two vortices giving an increased basic burning stability.

The outer wall also protects the jet pipe from excess heat.

13 Claims, 4 Drawing Figures

REHEAT SYSTEMS FOR GAS TURBINE ENGINES

Figure 1:
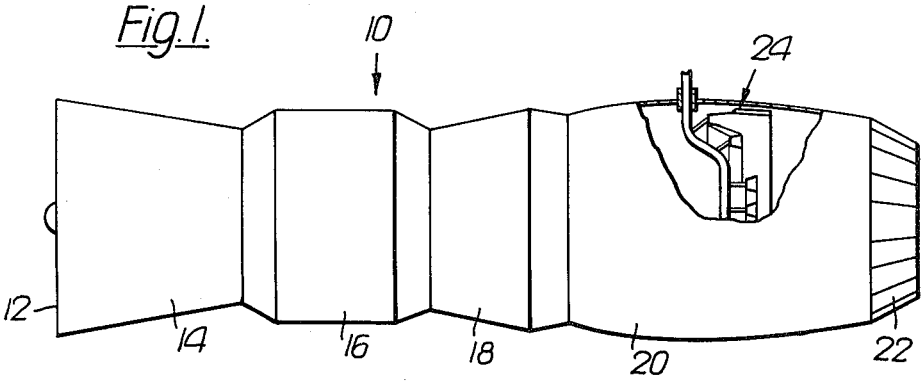

This invention relates to reheat systems for gas turbine engines.

It is usual in gas turbine engines which are intended for use in aircraft designed to fly at very high or supersonic speeds to provide means to significantly increase the thrust of the engine when such high or supersonic speeds are required.

This is normally achieved by augmenting the thrust of the engine with a reheat system. After the combustion gases are discharged from the gas turbine into the jet pipe of the engine, some additional thrust potential remains since not all of the available oxygen has been consumed. By supplying more fuel to the jet pipe, and providing ingnition means, this additional thrust can be realised by consuming the remaining oxygen. Since such a system uses an extra fairly large fuel flow, the system is not normally used continuously, but only for relatively brief periods of time, so that considerable amounts of fuel need not be carried, and/or the range of the aircraft is not sustantially reduced.

A typical reheat system consists of a series of annular channel-shaped gutters arranged at the upstream end of the jet pipe and an array of fuel supply manifolds immediately upstream of the gutters. The gutters serve to stabilize the flames formed in the jet pipe when the fuel flow is initiated and the resulting fuel/gas mixture ignited.

The flame stabilization can be a problem however with these gutters, since the flames can sometimes be extinguished by rapid changes in jet pipe pressure, and it is also important that the walls of the jet pipe do not reach excessive temperatures leading to distortion or even melting of the jet pipe walls.

It is an object of the present invention therefore to provide a reheat system for a gas turbine engine which will improve the stability of the flames and not permit the jet pipe walls to reach excessive temperatures.

According to the present invention a reheat system for a gas turbine engine comprises a plurality of coaxially arranged annular gutters mounted in the engine jet pipe, fuel injection means for injecting fuel into the jet pipe upstream of the gutters, the radially outermost gutter being located adjacent to the wall of the jet pipe and having a substantially channel-shaped cross-section, the outer wall of the outermost gutter extending axially along the length of the jet pipe for a substantially further distance than the inner wall of the outermost gutter.

The axial length of the outer wall of the outermost gutter is preferably at least twice the length of the inner wall and may be over three times the length thereof.

A reinforcing annulus may be arranged adjacent to at least a portion of the outer wall of the outermost gutter and be adapted to support the outer wall.

The substantially channel-shaped cross-section of the outermost gutter is preferably asymmetrical, the inner wall of the gutter being arranged at a greater angle to the axis of the jet pipe than the outer wall.

The outer wall of the outermost gutter may be straight in section, or may have a curve or bend along its length. Preferably the upstream portion of the outer wall is arranged at a small acute angle to the axis of the jet pipe and the downstream portion is arranged substantially parallel to the axis of the jet pipe.

The outermost gutter may be provided internally with a fuel supply duct for the flow of primary fuel therefrom, and the gutter may have holes or perforations in its upstream wall for the admission of fuel/gas mixture into the gutter.

The outermost gutter is preferably located upstream of the remainder of the gutters.

The invention also comprises a gas turbine engine having a reheat system as set forth above.

Figure 2:
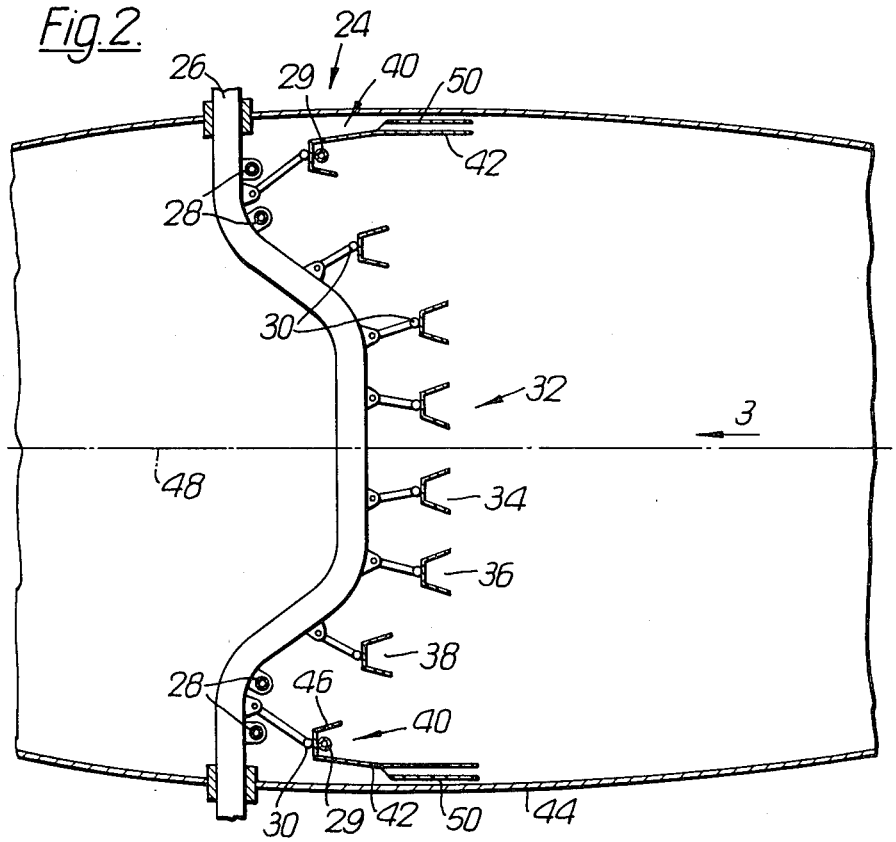
Figure 3:
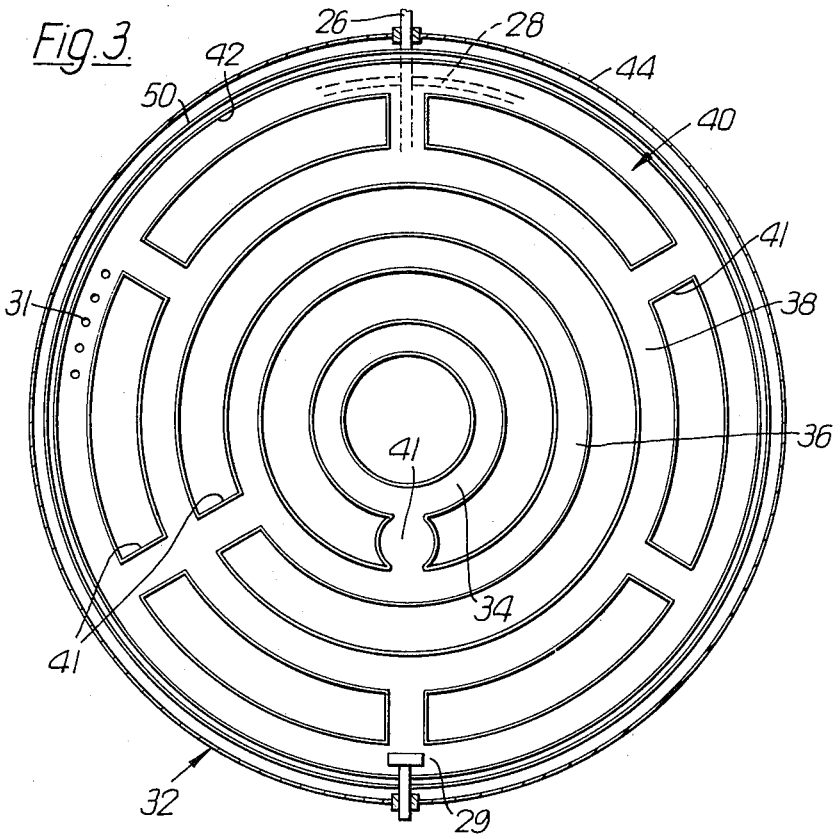
Figure 4:
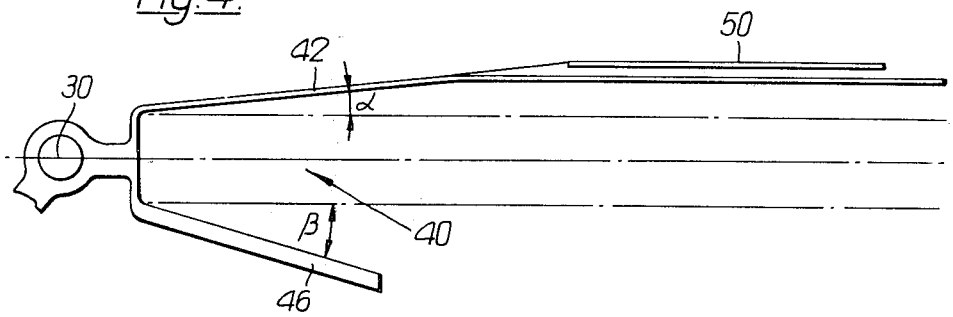

An embodiment of the invention will now be described by way of example only, in which:

FIG. 1 is a partially cutaway view of a gas turbine engine having a reheat system in accordance with the invention, FIG. 2 is a cross-sectional view of the gutter arrangement of the reheat system on an enlarged scale, FIG. 3 is a view of the reheat system from arrow 3 in FIG. 2, and FIG. 4 is a cross-sectional view of the outermost gutter on an enlarged scale.

In FIG. 1 there is shown a gas turbine engine 10 having an air inlet 12, compressor means 14, combustion equipment 16, turbine means 18 and a jet pipe 20. Inside the jet pipe is arranged a reheat system 24 and a variable area nozzle 22 is located at the downstream end of the jet pipe 20.

The reheat system 24 is shown in more detail in FIGS. 2 and 3 and comprises basically a fuel supply duct 26 which supplies a number of coaxial annular fuel manifolds 28 (only two of which are shown) with a full fuel flow, and a number of coaxial annular fuel manifolds 30 with a primary fuel flow. The supply duct 26 is supplied from a reheat fuel control unit (not shown) and is connected at its lower end to a fuel drains system (also not shown).

Located immediately downstream of the fuel supply duct 26 is an array of coaxial annular flame stabilizing gutters 32. In this embodiment four annular gutters 34, 36, 38 and 40 are provided, these being interconnected by radially extending gutters 41 (see FIG. 3) for initial light up purposes.

Each of the gutters 34, 36 and 38 have substantially channel-shaped cross-sections with slightly diverging side walls. The gutters 34 and 36 are arranged substantially concentrically, the gutter 38 is slightly upstream of the gutters 34 and 36 whilst the outermost gutter 40 is arranged slightly upstream of the gutter 38. The gutter 40 is provided with a plurality of primary fuel supply ducts 29 arranged circumferentially within the gutter and at the upstream end of the gutter. The gutter 40 is also provided with a number of holes or slots 31 arranged circumferentially in its upstream wall for the admission of fuel/gas mixture into the gutter. A primary fuel supply duct 29 and several holes 31 are illustrated in FIG. 3.

The gutter 40 also has a substantially channel-shaped cross-section with diverging walls, as the others, but the outer wall 42 i.e. that nearest the jet pipe wall 44, is extended to over three times the axial length of its inner wall 46. The outer wall 42 may be only at least twice as long as the wall 46. The upstream portion of outer wall 42 is also arranged at a smaller acute angle $\alpha$ (see FIG. 4) to the axis 48 of the jet pipe than the angle $\beta$ of the inner wall 46, the downstream portion of the wall 42 being substantially parallel with the axis of the jet pipe.

Located adjacent the downstream portion of the wall 42 is an annular stiffening ring 50 intended to support and prevent vibration of the end of the extended outer wall 42.

In operation of the system the normally shaped gutters 34, 36, 38 cause double vortices to be produced within the channels, but the gutter 40 causes only a single vortex to be produced due to the presence of the extended wall 42. The vortex dimension is thus increased resulting in improved basic burning stability with less chance of the flame being extinguished with varying jet pipe pressures.

The outermost main fuel supply mainifold is arranged to supply fuel towards the radially inner side of the gutter 40 and this reduces the risk of fuel injection on to the jet pipewall 44 with consequent burning of the fuel adjacent to the jet pipe wall and excessive temperatures being experienced thereby. The extended outer wall 42 of the gutter 40 also helps to prevent fuel from reaching the jet pipe wall 44 as well as keeping the flame from the gutter clear of the jet pipe wall.

The arrangement thus enables the jet pipe wall 44 and the nozzle 22 to be maintained relatively cool, which is particularly important where the jet pipe is of short axial length and small overall diameter.

We claim:

1. A reheat system for a gas turbine engine having a jet pipe, said reheat system comprising:

a plurality of gutters, said gutters being annular in shape and being coaxially arranged in the jet pipe of said engine;

fuel injection means, said fuel injection means being operable for injecting fuel into said jet pipe upstream of said plurality of gutters, the radially outermost gutter having an outer wall and an inner wall to define a substantially channel shaped cross-section, said outer wall being located adjacent to the wall of said jet pipe and extending along the length of said jet pipe for a substantially further distance than said inner wall, and said outer wall comprising an upstream portion and a downstream portion, said upstream portion being arranged at a small acute angle to the axis of said jet pipe, and said downstream portion being arranged substantially parallel to the axis of said jet pipe.

2. A reheat system as claimed in claim 1 wherein the axial length of said outer wall is at least twice the length of said inner wall.

3. A reheat system as claimed in claim 2 wherein said axial length of said outer wall is over three times the length of said inner wall.

4. A reheat system as claimed in claim 1 comprising a reinforcing annulus, said reinforcing annulus being arranged adjacent to at least a portion of said outer wall and being adapted to support said outer wall.

5. A reheat system as claimed in claim 1 in which said cross-section of said outermost gutter is asymmetrical.

6. A reheat system as claimed in claim 5 in which said inner wall is arranged at a greater angle to the axis of said jet pipe than the outer wall.

7. A reheat system as claimed in claim 1 comprising a fuel supply duct for the supply of primary fuel, said fuel supply duct being located internally of said outermost gutter.

8. A reheat system as claimed in claim 1 in which said outermost gutter is provided with holes or perforations in its upstream wall for the admission of fuel/gas mixture into said outermost gutter.

9. A reheat system as claimed in claim 1 in which said outermost gutter is located upstream of the remainder of said gutters.

10. A reheat system for a gas turbine engine having a jet pipe, said reheat system comprising a plurality of gutters, said gutters being annular in shape and being coaxially arranged in the jet pipe of said engine, fuel injection means, said fuel injection means being operable for injectiong fuel into said jet pipe upstream of said plurality of gutters, the radially outermost gutter having an outer wall and an inner wall to define a substantially channel shaped cross-section, said outer wall having an axial length at least twice the length of said inner wall and being located adjacent to the wall of said jet pipe and extending axially along the length of said jet pipe for a substantially further distance than said inner wall.

11. A reheat system as claimed in claim 10 wherein the axial length of said outer wall is over three times the length of said inner wall.

12. A reheat system as claimed in claim 10 in which said outer wall is straight in section.

13. A reheat system as claimed in claim 10 in which said outer wall has a curve or bend along its length.

* * * * *